US007442904B2

(12) United States Patent
Kirby

(10) Patent No.: US 7,442,904 B2
(45) Date of Patent: Oct. 28, 2008

(54) METAL SHEATHED HEATER AND THERMOSTAT ASSEMBLY AND METHOD OF USE

(75) Inventor: Robert Kirby, Sparta, TN (US)

(73) Assignee: Tutco, Inc., Cookeville, TN (US)

( * ) Notice: Subject to any disclaimer, the term of this patent is extended or adjusted under 35 U.S.C. 154(b) by 74 days.

(21) Appl. No.: 11/355,891

(22) Filed: Feb. 17, 2006

(65) Prior Publication Data

US 2006/0191904 A1 Aug. 31, 2006

Related U.S. Application Data

(63) Continuation-in-part of application No. 11/064,845, filed on Feb. 25, 2005, now Pat. No. 7,230,214.

(51) Int. Cl.
*H05B 3/08* (2006.01)
*H05B 3/16* (2006.01)

(52) U.S. Cl. ..... 219/541; 219/543

(58) Field of Classification Search ..... 219/541, 219/538, 542, 543, 544, 545, 546, 552, 540
See application file for complete search history.

(56) References Cited

U.S. PATENT DOCUMENTS

| | | | | |
|---|---|---|---|---|
| 3,184,535 | A | 5/1965 | Worthington | |
| 3,387,364 | A | 6/1968 | Boggs | |
| 4,517,449 | A * | 5/1985 | Chazan et al. | 219/549 |
| 4,553,023 | A * | 11/1985 | Jameson et al. | 392/472 |
| 4,742,210 | A * | 5/1988 | Tsuchiyama et al. | 219/541 |
| 5,006,286 | A | 4/1991 | Dery et al. | |
| 6,423,952 | B1 * | 7/2002 | Meisiek | 219/544 |
| 2002/0055300 | A1 | 5/2002 | Scherb | |

FOREIGN PATENT DOCUMENTS

EP 1 289 064 A2 3/2003

* cited by examiner

*Primary Examiner*—Daniel L Robinson
(74) *Attorney, Agent, or Firm*—Clark & Brody

(57) ABSTRACT

A metal sheathed heater includes a thermostat, a means for mounting the thermostat in a secure location, and a joint interconnecting the thermostat with a source of power and a lead wire of the metal sheathed heater. The joint is a type that is moisture and abrasion resistant, mechanically strong, and electrically insulating.

5 Claims, 4 Drawing Sheets

METAL SHEATHED HEATER AND THERMOSTAT ASSEMBLY AND METHOD OF USE

This application is a continuation in part of application Ser. No. 11/064,845 filed on Feb. 25, 2005 now U.S. Pat. No. 7,230,214, which is incorporated herein in its entirety.

FIELD OF THE INVENTION

The present invention is directed to a metal sheathed heater and thermostat assembly and to the use of the assembly in heating applications, particularly compressors and the like.

BACKGROUND ART

The use of metal sheathed heaters is well known in the prior art. Typically, these heaters use resistance heating wherein a resistance heating wire or heater cable is encased in a metal sheath. The metal sheath is in contact with the item or material to be heated. These heaters are often referred to as belly-band, crankcase, compressor or sump heaters and are often times used to heat refrigeration compressors or air-conditioning compressors. The heater can employ a standard hose clamp or other type of clamping arrangement for attachment to the compressor. The standard hose clamp is cut in two pieces with each piece affixed (welded for example) to opposite ends of the heater's metal sheath. Assembly of the heater to the compressor is accomplished by engaging the two ends of the clamp as intended and then tightening the assembly around the selected compressor location. This type of heater construction can also be used for heating containers such as barrels, heating pipes, etc.

The belly-band heater has an insulated electric lead wire exiting each end of the metal sheath. A frequent requirement in the use of these heaters is for the lead wires to be routed in standard metal conduit. Further, it is often required that the conduit enclose the lead wires from the point where each lead exits the heater sheath to where the lead wires enter an electrical junction box or boxes.

FIG. 1 shows a typical metal sheathed heater or electric belly-band heater designated by the reference numeral 10 and including hose clamp pieces 1 and 3, and a screw mechanism 5. A metal sheath 7 extends between the two pieces 1 and 3, with the hose clamp pieces attached to the sheath by welding or the like. The metal sheath 7 encases an electrically insulated resistance heating wire or heater cable 9 and includes a fluted strip portion 8, which interfaces with the equipment or material requiring heating.

In these types of metal sheathed heaters, it is well known in the industry that the heater cable is composed of resistance wire spiraled around a flexible core made of an electrically insulated and thermally resistant material such as fiberglass or other suitable material. This element is commonly referred to as a "heater core wire". After the heater core wire is uniformly coated with an insulating material having sufficient mechanical and electrical resistance properties so as to remain flexible yet electrically isolated, it is normally called a "heater cable". The insulating material is often silicone or a thermosetting plastic with adequate thermal properties for its intended use.

In connecting the heater cable to the lead wires, a small length of insulation is stripped from each end of the heater cable. Two flexible electrically insulated stranded lead wires with a small length of insulation stripped from one end of each wire are electrically connected, one to each end of the heater cable, by crimping or splicing the stripped ends of the heater cable to stripped ends of the lead wires. The connector used is a properly selected metal splice connector with sufficient temperature resistance, corrosion resistance, mechanical strength and formability to make a secure electrical bond. In the embodiment shown in FIG. 1, the lead wires 11 are connected to the heater cable using connections that are in turn encased in the metal sheath as is disclosed in co-pending patent application Ser. No. 11/064,845 filed, owned by the assignee of this application. The connection between the lead wires and heater cable can be made outside the metal sheath if so desired.

These types of heaters are commercially available from Tutco, Inc, of Cookeville, Tenn., one being Model CH, and are also disclosed in U.S. Pat. No. 6,844,531 to Kirby, which is herein incorporated in its entirety by reference.

In the prior art, these types of metal sheathed heaters e.g., electric resistance compressor heaters, when installed on a compressor that is part of a total system or controlling unit, remain constantly powered regardless of temperature as long as the controlling unit that the heater serves demands power. During certain periods, temperature conditions occur for which the electric resistance compressor heater does not need to operate even though the controlling unit demands power. As a result electrical energy is consumed which is a waste of resources. The use of positive temperature coefficient resistance heaters for heating compressors only partially reduces the use of electrical energy and is not a solution to this problem.

Attempts to use various thermostats to control electric resistance compressor heaters have not been successful. Compressor heaters must operate in moist to wet environments. Therefore, finding a practical solution to this dilemma remains a problem for those seeking to use metal sheathed heaters in an efficient manner.

The present invention overcomes the problems noted above by providing a metal sheathed heater and a thermostat assembly, with the thermostat interposed between the heater and a power source using a mechanically strong, abrasive resistant, moisture resistant, electrically insulating joint.

SUMMARY OF THE INVENTION

A first object of the present invention is a metal sheathed heater and thermostat assembly.

Another object of the invention is a metal sheathed heater and thermostat assembly that has a mechanically strong, abrasive resistant, moisture resistant, electrically insulating joint that interconnects the thermostat to the heater and a source of power.

Yet another object of the invention is an improvement in the method of heating a media using a metal sheathed heater, wherein the heating is controlled using a thermostat.

Other objects and advantages of the present invention will become apparent as the description thereof proceeds.

The invention is an improvement in heaters employing a metal sheath encasing a heater cable, a clamp assembly attached to ends of the metal sheath for securing the metal sheath to a component for heating purposes, lead wires, and a splice connection where each end of the heater cable connects to a respective end of each lead wire.

In one embodiment of the invention, the metal sheathed heater is combined with a thermostat that includes a pair of thermostat lead wires. One thermostat lead wire is adapted to connect to one of the heater lead wires with the other thermostat lead wire adapted to connect to a source of power. Means for mounting the thermostat to a structure to allow for temperature sensing are provided. In addition, the assembly includes a connection joining the one heater lead wire to the one wire of the pair of lead wires, the connection being a high strength, moisture and abrasion resistant, and electrically insulating type.

While the mounting means can be any type to position the thermostat of the thermostat assembly in a desired location, one example includes the use of pair of mounting legs adapted to be fastened to the structure.

While the connection can be virtually any type that would electrically link one end of the lead wire of the metal sheathed heater to the one lead wire of the thermostat assembly, one preferred connection is a splice connection that comprises a crimpable splice interconnecting the wire portion of each of the one thermostat lead wire and the one heater lead wires, a layer of adhesive covering an end portion of an insulating layer of the one heater wire and the one thermostat lead wire and crimpable splice, and a heat shrinkable tube sized to cover the end portions and the crimpable splice.

The splice connection can also employ a potting material interposed between both of the crimpable splice and the end portions and the adhesive, or use the potting material in place of the adhesive. In a further embodiment, the connection can use the crimpable splice and potting material alone.

The invention also includes the use of the inventive metal sheathed heater and thermostat assembly to control the heating of the heater. The thermostat can be placed in virtually any location to obtain the desired control of the heater, e.g., in a location that permits sensing of ambient temperature, a location that senses the structure being heated, or a structure adjacent or in the vicinity of the structure being heated.

BRIEF DESCRIPTION OF THE DRAWINGS

Reference is now made to the drawings of the invention wherein.

DESCRIPTION OF THE PREFERRED EMBODIMENTS

The present invention offers significant improvements in the field of metal sheathed heaters, including the heaters themselves, and their methods of use. By the use of the invention, improvements are realized in operation of the metal sheathed heaters in terms of energy usage. Also, the design of the heater and thermostat assembly is durable so that the connections between the heater, thermostat and power source are not compromised by the environment of the heater installation or activity occurring in the environment of installation and/or use.

Figure 1:
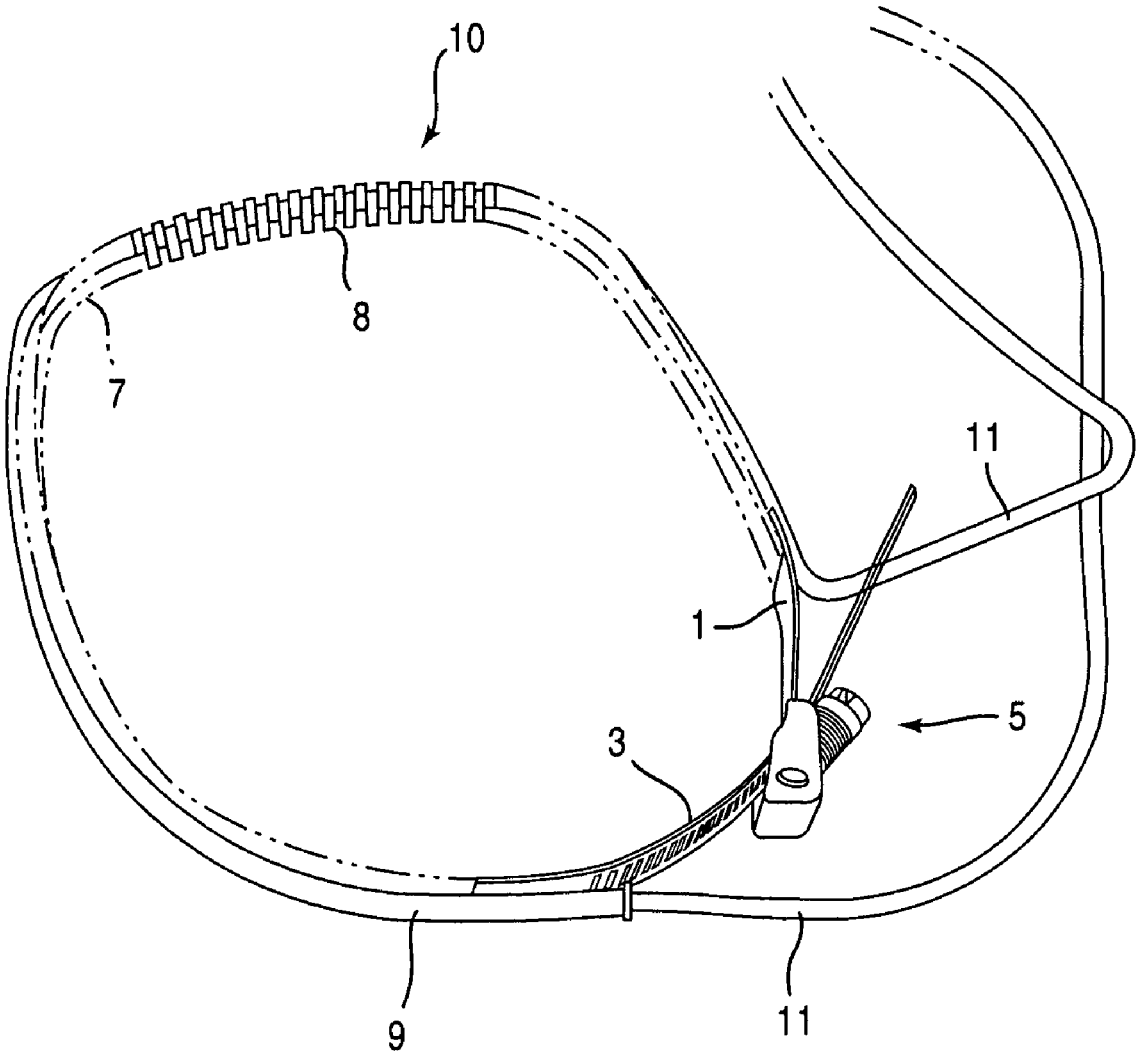
FIG.1 PRIOR ART
FIG. 1 is a perspective view of a prior art electric metal sheathed heater.
Figure 2:
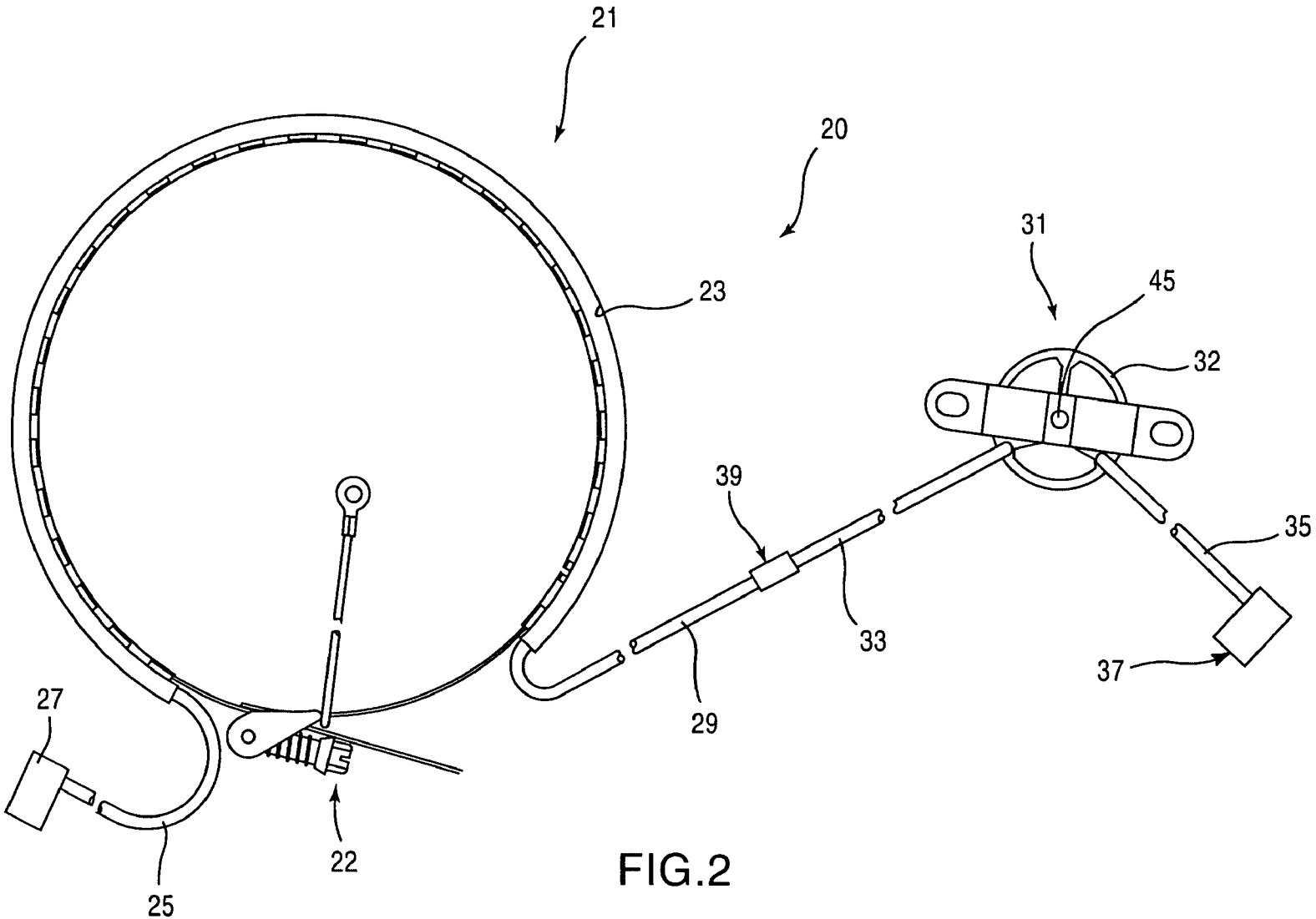
FIG. 2 is a side view of an exemplary embodiment of the metal sheathed heater and thermostat assembly.

FIG. 2 shows one embodiment of the invention, wherein the metal sheathed heater and thermostat assembly is designated by the reference numeral 20 and is seen to include a metal sheathed heater 21 having a clamp assembly 22, metal sheath 23, one lead wire 25 with a flag 27 at its termination for connection to a source of power (not shown) and a second lead wire 29.

The assembly 20 also includes a thermostat assembly 31, which has a pair of lead wires 33 and 35 extending therefrom. Lead wire 35 is shown with a flag 37 at its end for connection to a source of power. The assembly 31 includes a thermostat body 32 that can be any type but a preferred type is a sealed one that is moisture proof and is readily available from a number of sources, including Thermo-O-Disc of Mansfield, Ohio. These thermostats typically have contacts that open or close depending on temperature. Once the temperature increases to a certain level, the contacts would open to disconnect the heater 21 from power to save energy.

A joint or connection 39 is shown interconnecting the lead wire 29 of the metal sheathed heater 21 to the lead wire 33 of the thermostat 31. The connection is described in more detail below.

Figure 3:
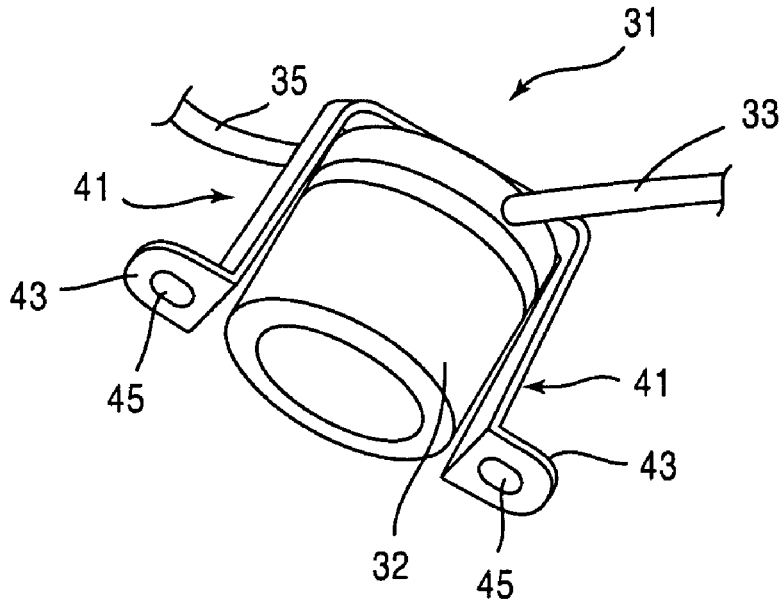
FIG. 3 is a bottom perspective view of the thermostat and its mounting.
Figure 4:
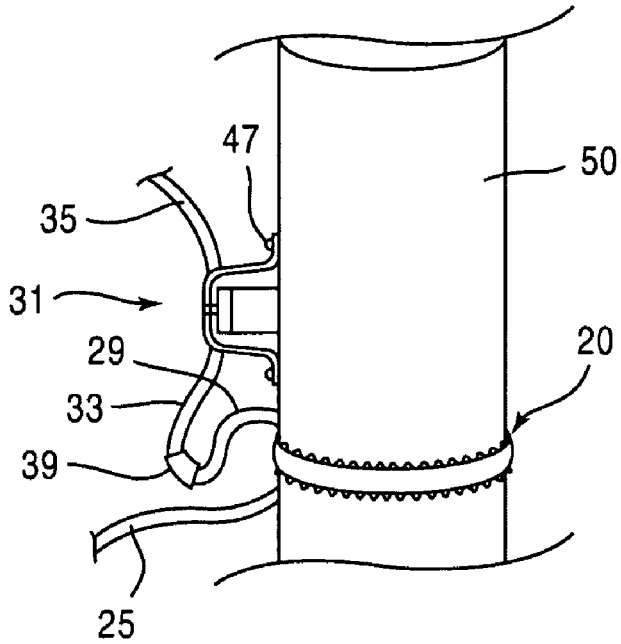
FIG. 4 is a schematic of an exemplary mounting arrangement.

Referring to FIGS. 2-4, the thermostat assembly 31 includes means for mounting it to a structure that is being heated or a structure that provides support for the heater to be used in its intended purpose. In FIG. 3, the mounting means is shown as a pair of legs 41, attached to the body 32 at 45 using a fastener or other means of attachment, see FIG. 2. Each leg 41 has a flange 43 with an opening 45 to facilitate mounting of the assembly 20 in a given location.

FIG. 4 shows an exemplary mounting wherein the thermostat assembly 20 is mounted to a compressor 50 being heated by a metal sheathed heater 21. Fasteners 47 are employed for mounting purposes. Although a flanged leg and fastener arrangement is shown for mounting the thermostat body 32 to a compressor, virtually any type of mounting means could be employed to secure the thermostat body in a desired location. For example, the thermostat body 32 could be mounted to a plate, with the plate being attached to the appropriate structure. The mounting means could be attached to one structure with the thermostat monitoring the temperature of a nearby structure or ambient air.

The location of mounting can be virtually anywhere that control of temperature is important for the heating operation using the metal sheathed heater 21. For example, it may be desirable to regulate the metal sheathed heater based on ambient temperature rather a temperature associated with a compressor or the like. In this instance, the thermostat would be mounted to structure in such a way that ambient temperature can be sensed for heater control. Alternatively, the temperature of a structure adjacent that being heated may require monitoring, and the thermostat assembly 31 would be mounted to monitor the temperature of the adjacent structure.

Figure 5A:
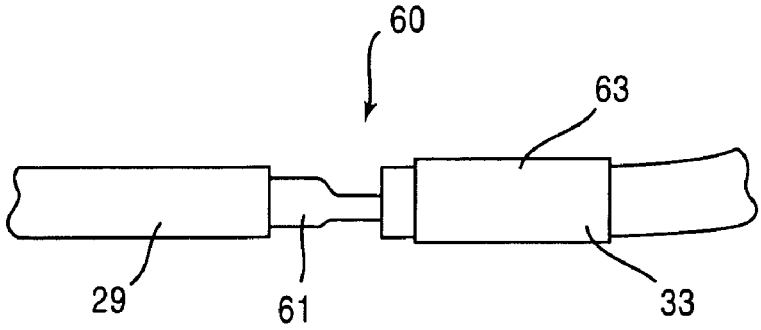
FIGS. 5*a*-5*c* are schematics of exemplary splice connection.
Figure 5B:
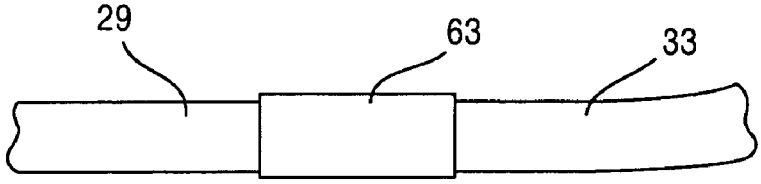

Referring now to FIGS. 5*a*-5*b*, a connection linking the thermostat assembly 31 to the metal sheathed heater 21 is shown as a splice connection 60. This connection includes a metal splice 61 that can be crimped onto the exposed wires of both of the metal sheathed heater lead wire 29 and lead wire 33 of the thermostat, and a length of heat shrinkable tube 63.

The connection is made by stripping the insulation from the end of metal sheathed heater lead wire 29 and from the end of one thermostat lead wire 33. The metal splice 61 is securely crimped on the exposed wires so as to electrically connect and mechanically secure the two stripped wire ends.

The heat shrinkable tube 63 is of sufficient length to adequately overlap the insulation on end portions of two wires 29 and 33. As seen in FIG. 5*a*, the heat shrinkable tube 63 is placed on the lead wire 33 prior to the crimping step so that it can be moved over to cover the metal splice 61 and ends of the lead wires 29 and 33, see FIG. 5*b*.

Figure 5C:
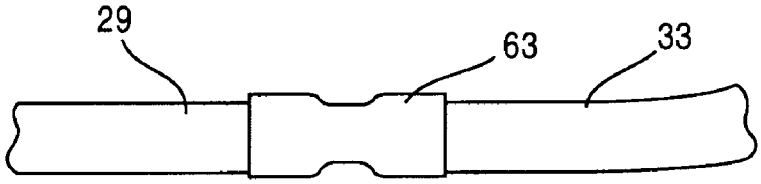

An adhesive is preferably employed between the tube 63 and both the splice 63 and end portions of the wires 29 and 33. Preferably, the adhesive is on the inside surface of the tube that is placed over the joint, but it could be applied to the splice and wire ends as well independent of the tube 63. Heat is applied to both shrink the tube and activate the sealing adhesive to form a finished connection as shown in FIG. 5*c*.

The characteristics of the tube is that it is made of a material that will, under heat, shrink to a predetermined smaller diameter thus providing a secure, sealed joint. This characteristic is referred to as "heat shrinkable" and the tube is referred to as a "heat shrinkable tube". The use of heat shrinkable tubes is well known in the prior art. The plastic heat shrinkable tube material has sufficient electrical resistance, mechanical strength and temperature resistance for the intended application. The tube is tough, providing protection from mechanical abrasion as may occur during installation and service. The adhesive has such properties that at operating temperatures it neither hardens and breaks nor runs out of the area, retains its properties and thereby forms a seal where the inner surface of the shrinkable tube contacts the outer diameter of both the heater cable wire insulation and the lead wire insulation. Though not necessary, after the shrinking process sufficient adhesive is present to completely coat the splice area and fill cavities between the inner surface of the tube and the outer surfaces of the splice area. The presence of entrapped air bubbles around the splice area is not detrimental to the seal. One example of an adhesive for use as part of the splice connection is a thermoplastic adhesive or hot melt adhesive, known as Macromelt adhesive with designation TPX-20-239 and made by Macromelt Adhesive, but other adhesives having the properties noted above are also suitable.

Figure 6:
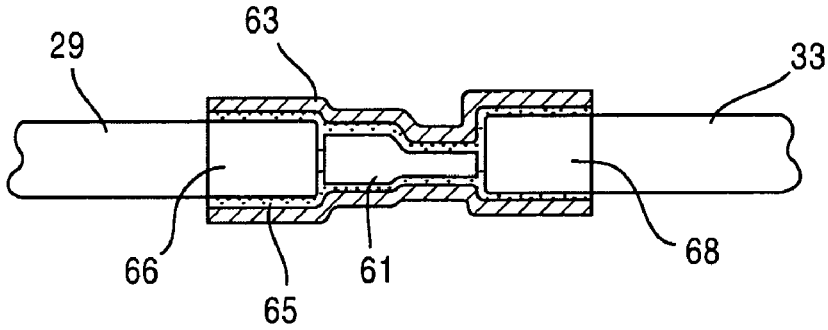
FIG. 6 shows the splice connection of FIG. 5*c* in cross section.

FIG. 6 shows a cross section of the connection 60 showing the adhesive 65. As is evident from this view, the adhesive coats the splice 63 and end portions 66 and 68 of the two lead wires 29 and 33, respectively, to assist in forming a water tight, high strength and tough connection.

The splice connection of FIGS. 5*a*-5*b* is one way to connect the thermostat assembly 31 to the metal sheathed heater 21 but other means may be used to cover the joint. One example is to first seal the joint with a water proof, temperature resistant, electrical resistant seal or potting material, then use a heat shrinkable tube as described above, with or without an adhesive on its inside surface or applied over the seal or potting material to cover the joint. These types of potting materials or seals are well known in the heater art, and an example is discussed in U.S. Pat. No. 4,236,065 to Yashin, herein incorporated in its entirety by reference.

In the embodiment of the invention employing a potting material, the connection would appear similar to that shown in FIG. 6 with the potting material either replacing the adhesive or being used in addition thereto.

Figure 7:
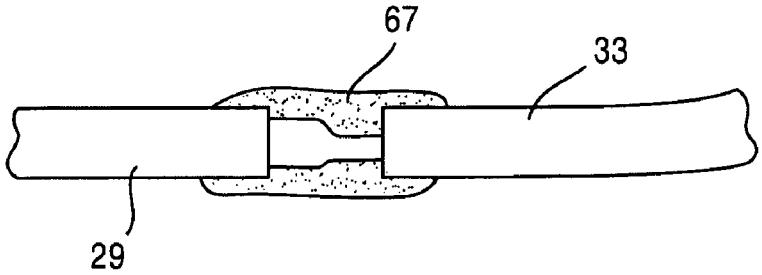
FIG. 7 shows an alternative splice connection.

As another embodiment and referring to FIG. 7, a sufficiently thick, water proof, temperature resistant, electrical resistant, mechanically strong seal or potting material 67 may be used to cover the joint.

Features of the new invention include but are not limited to an electrical resistance compressor or other component heater with a thermostat attached, and particularly with a thermostat that is sealed to moisture.

Other features include the electrical resistance compressor heater with a thermostat attached that has a lead wire of the heater adequately crimped to a lead wire of the thermostat, with the lead wire of sufficient length for practical use. The thermostat should have a means for mounting and the connection should be one that is mechanically strong, abrasion resistant, sealed electrically, temperature resistant and sealed to prevent moisture penetration. The connection can also include a mechanically strong and abrasion resistant cover as a heat shrinkable tube, which either covers a previously applied layer of a thermally activated adhesive or serves as a carrier of a thermally activated adhesive. Alternatively, the connection can be formed by a molding or potting material in combination with the mechanically strong and abrasion resistant heat shrinkable tube or tube and adhesive, or just a sufficiently thick, tough, mechanically strong and abrasion resistant sealer or potting material.

As such, an invention has been disclosed in terms of preferred embodiments thereof which fulfills each and every one of the objects of the present invention as set forth above and provides a new and improved metal sheathed heater and thermostat assembly and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In an heater having a metal sheath encasing a heater cable, a clamp assembly attached to ends of the metal sheath for securing the metal sheath to a component for heating purposes, heater lead wires, and a connection where each end of the heater cable connects to a respective end of each heater lead wire, the improvement comprising a thermostat with a pair of thermostat lead wires forming an assembly with the metal sheathed heater, one thermostat lead wire adapted to connect to one of the heater lead wires with the other thermostat lead wire adapted to connect to a source of power, means for mounting the thermostat to a structure to allow for temperature sensing, and a connection joining the one heater lead wire to the one wire of the pair of lead wires, the connection being a high strength, moisture and abrasion resistant, and electrically insulating type, wherein the connection is one of the following:

a) a splice connection further comprising a crimpable splice interconnecting the wire portion of each of the one thermostat lead wire and the one heater lead wire, a layer of adhesive covering an end portion of an insulating layer of the one heater wire and the one thermostat lead wire, and a heat shrinkable tube sized to cover the end portions and the crimpable splice;

b) a splice connection further comprising a crimpable splice interconnecting the wire portion of each of the one thermostat lead wire and the one heater lead wire, a potting material covering the crimpable slice and an end portion of an insulating layer of the one heater lead wire and the one thermostat lead wire, and a heat shrinkable tube sized to cover the potting material; or c) a splice connection further comprising a crimpable splice interconnecting the wire portion of each of the one thermostat lead wire and the one heater lead wire, and a potting material covering the crimpable splice and an end portion of an insulating layer of each of the one heater lead wire and the one thermostat lead wire.

2. The assembly of claim 1, wherein the means for mounting are a pair of mounting legs adapted to be fastened to the structure.

3. The heater of claim 1, wherein when the splice connection is according to (a), a potting material is interposed between both of the crimpable splice and the end portions and the adhesive.

4. In a method of heating a structure using a metal sheathed heater, the improvement comprising heating the structure using the heater and thermostat assembly of claim 1, and controlling the extent of heating using the thermostat.

5. The method of claim 4, wherein the thermostat senses one of ambient temperature, a temperature associated with the structure being heated, or a temperature of a structure adjacent the structure being heater for control of the metal sheathed heater assembly.

* * * * *